US005412958A

United States Patent [19]

Iliff et al.

[11] Patent Number: 5,412,958

[45] Date of Patent: May 9, 1995

[54] LIQUID/SUPERCRITICAL CARBON DIOXIDE/DRY CLEANING SYSTEM

[75] Inventors: Robert J. Iliff, Oakley; James D. Mitchell, Alamo; Daniel T. Carty, Danville; James R. Latham, Livermore; Stephen B. Kong, Alameda, all of Calif.

[73] Assignee: The Clorox Company, Oakland, Calif.

[21] Appl. No.: 162,563

[22] Filed: Dec. 6, 1993

Related U.S. Application Data

[63] Continuation-in-part of Ser. No. 912,932, Jul. 13, 1992, Pat. No. 5,267,455.

[51] Int. Cl.[6] ..... D06F 43/02

[52] U.S. Cl. ..... 68/5 C; 34/72

[58] Field of Search ..... 68/5 C, 18 R, 18 C, 68/18 F; 134/95.1; 34/26, 32, 36, 72, 74

[56] References Cited

U.S. PATENT DOCUMENTS

| | | | |
|---|---|---|---|
| 3,969,196 | 7/1976 | Zosel . | |
| 4,012,194 | 3/1977 | Maffei . | |
| 4,219,333 | 8/1980 | Harris . | |
| 4,308,200 | 12/1981 | Fremont | 260/110 |

(List continued on next page.)

FOREIGN PATENT DOCUMENTS

| | | |
|---|---|---|
| 0518653A1 | 12/1992 | European Pat. Off. . |
| 0530949A1 | 3/1993 | European Pat. Off. . |
| 2027003 | 6/1970 | Germany . |
| 3906735 | 6/1990 | Germany . |
| 3904513 | 8/1990 | Germany . |

(List continued on next page.)

OTHER PUBLICATIONS

Pellerin, "Supercritical Fluid Extraction of Natural Raw Materials for the Flavor and Perfume Industry," *Perfumer and Flavorist,* vol. 16, pp. 37–39 (1991).

Tateo, et al., "Production of Rosemary Oleoresin Using Supercritical Carbon Dioxide," *Perfumer and Flavorist,* vol. 12, pp. 27–34 (1988).

Warren et al., "Mood Benefits of Fragrance," *Perfumer and Flavorist,* vol. 18, pp. 7–16 (1993).

Buchbauer, "Aromatherapy: Do Essential Oils Have Therapeutic Properties?" *Perfumer and Flavorist,* vol. 15, pp. 47–50 (1990).

JP62-172096, Jul. 29, 1987, "Extraction of Essential Oil . . . Using Sub or Supercritical Fluid, Pret. Carbon Dioxide . . . " (Abstract Only).

WO90-02836, Mar. 22, 1990, "Supercritical Delignification of wood . . . " (Abstract Only).

Klemola et al., "Vanilla Prepn. . . . Supercritical Carbon Dioxide," U.S. 4,847,422 (among others), Jul. 11, 1989 (Abstract Only).

U.S. 4,308,200, Dec. 29, 1981, "Extracting Tall Oil and Turpentine . . . using Supercritical Carbon Dioxide" (Abstract Only).

JP 63-297499, Dec. 5, 1988, "New Chrysanthemum Extract Prepn . . . Supercritical Pressure" (Abstract Only).

Henkel, DE 3,319,184, Nov. 29, 1984, "Sepn. of Allergenic . . . Supercritical Carbon Dioxide," (Abstract Only).

(List continued on next page.)

*Primary Examiner*—Philip R. Coe

*Attorney, Agent, or Firm*—Joel J. Hayashida; Michael J. Mazza; Harry A. Pacini

[57] ABSTRACT

A dry cleaning system particularly suited for employing supercritical $CO_2$ as the cleaning fluid consisting of a sealable cleaning vessel containing a rotatable drum adapted for holding soiled substrate, a cleaning fluid storage vessel, and a gas vaporizer vessel for recycling used cleaning fluid is provided. The drum is magnetically coupled to a motor so that it can be rotated during the cleaning process. The system is adapted for automation which permits increased energy efficiency as the heating and cooling effect associated with $CO_2$ gas condensation and expansion can be channeled to heat and cool various parts of the system.

3 Claims, 3 Drawing Sheets

U.S. PATENT DOCUMENTS

| | | | |
|---|---|---|---|
| 4,820,537 | 4/1989 | Katz | 426/481 |
| 5,013,366 | 5/1991 | Jackson et al. . | |
| 5,123,176 | 6/1992 | Yamada et al. | 34/32 |

FOREIGN PATENT DOCUMENTS

| | | |
|---|---|---|
| 3904514 | 8/1990 | Germany . |
| 4004111 | 8/1990 | Germany . |
| 3906724 | 9/1990 | Germany . |
| 90/06189 | 6/1990 | WIPO . |

OTHER PUBLICATIONS

A. Campbell et al., "Supercritical Carbon Dioxide of Wood," Int. Symp. Wood & Pulping Chem., Apr. 27–30, 1987 (Abstract Only).

Hatakeda et al., "Extraction of Sugi . . . Supercritical Carbon Dioxide," *Nippon Kagaka Kaiska* No. 5(1987) (Abstract Only).

Tateo et al., "The Composition and Quality of Supercritical Carbon Dioxide Extracted Cinnamon," J. Essent. Oil Res., vol. 1, pp. 165–8, (1989) (Abstract Only).

Temelli, et al., "Thermodynamic Analysis . . . Supercritical . . . ," *J. Ind. Eng. Chem. Res.,* vol. 29, pp. 618–624 (1990)(Abstract Only).

Sawamura et al., "Comparison of Peel Oil Components . . . by Supercritical Carbon Dioxide . . . ," *Nippon Shokunin Kogyo Gakkaish;* vol. 36, pp. 34–38 (1989)(Abstract Only).

Temelli, "Supercritical Fluid in Citrus Oil Processing," Food Technol., vol. 42, pp. 142–150 (1988)(Abstract Only).

Temelli, et al., "Supercritical Carbon Dioxide . . . Terpenes . . . ," ACS Symp. Ser. vol. 366, pp. 102–126 (1988)(Abstract Only).

Hawthorne et al., "Analysis of Flavor and Fragrance Compounds . . . Supercritical Fluid . . . ," *Anal. Chem.,* vol. 60, pp. 472–477 (1988)(Abstract Only).

Pellerin, "Extraction of Natural Odorous Raw Materials with Supercritical Carbon Dioxide," 1986, Parfums, Cosmet. Aromes, vol. 71, pp. 61–67 (Abstract Only).

Poulakis et al., "Dyeing Polyester in Supercritical $Co_2$," *Chemiefasern/Textilindustrie,* vol. 41/93 (Feb. 1991), pp. 142–147.

Cygnarowicz et al., "Effect of Retrograde Solubility on the Design Optimization of Supercritical Extraction Processes," *I&EC Research,* vol. 28, No. 10 (1989), pp. 1497–1503.

Motyl, Keith M., "Cleaning Metal Substrates Using Liquid/Supercritical Fluid Carbon Dioxide," Report by Rockwell International for U.S. Department of Energy, RFP-4150 (Jan. 1988), pp. 1–29 (odd pages).

Hyatt, John A., "Liquid and Supercritical Carbon Dioxide as Organic Solvents," *J. Org. Chem.,* vol. 49, No. 26 (1984), pp. 5097–5100.

Brogle, Heidi, "$CO_2$ as a Solvent: Its Properties and Applications," *Chemistry and Industry,* (Jun. 19, 1982), pp. 385–390.

Motyl, Keith M., "Cleaning Metal Substrates Using Liquid/Supercritical Fluid Carbon Dioxide," NASA Tech Briefs MFS-29611 (undated).

"Supercritical Fluids," *Kirk-Othmer Encyclopedia of Chemical Technology,* 3d edition, (1978), Supplement volume, pp. 875–893.

"Carbon Dioxide," *Kirk-Othmer Encyclopedia of Chemical Technology,* 3d edition (1978), vol. 4, pp. 725–742.

Francis, Alfred W., "Ternary Systems of Liquid Carbon Dioxide," vol. 58, (Dec. 1954), pp. 1099–1114.

LIQUID/SUPERCRITICAL CARBON DIOXIDE/DRY CLEANING SYSTEM

RELATED APPLICATIONS

This is a continuation-in-part of application Ser. No. 07/912,932, filed Jul. 13, 1992, and now U.S. Pat. No. 5,267,455.

FIELD OF THE INVENTION

This invention generally relates to an energy efficient dry cleaning system that employs supercritical carbon dioxide and that provides improved cleaning with decreased redeposition of contaminants, and reduces damage to polymer substrates.

BACKGROUND OF THE INVENTION

Cleaning contaminants from metal, machinery, precision parts, and textiles (dry cleaning) using hydrocarbon and halogenated solvents has been practiced for many years. Traditional dry cleaning machines operate typically as follows: a soiled garment is placed into a cylindrical "basket" inside a cleaning chamber which is then sealed. A non-polar hydrocarbon solvent is pumped into the chamber. The garment and solvent are mixed together by rotating the basket for the purpose of dissolving the soils and stains from the garment into the solvent, while the solvent is continuously filtered and recirculated in the chamber. After the cleaning cycle, most of the solvent is removed, filtered, and reused.

Recently the environmental, health, and cost risks associated with this practice has become obvious. Carbon dioxide holds potential advantages among other non-polar solvents for this type of cleaning. It avoids many of the environmental, health, hazard, and cost problems associated with more common solvents.

Liquid/supercritical fluid carbon dioxide has been suggested as an alternative to halocarbon solvents in removing organic and inorganic contaminants from the surfaces of metal parts and in cleaning fabrics. For example, NASA Technical Brief MFA-29611 entitled "Cleaning With Supercritical $CO_2$" (March 1979) discusses removal of oil and carbon tetrachloride residues from metal. In addition, Maffei, U.S. Pat. No. 4,012,194, issued Mar. 15, 1977, describes a dry cleaning system in which chilled liquid carbon dioxide is used to extract soils adhered to garments.

Such methods suggested for cleaning fabrics with a dense gas such as carbon dioxide have tended to be restricted in usefulness because they have been based on standard extraction processes where "clean" dense gas is pumped into a chamber containing the substrate and "dirty" dense gas is drained. This dilution process severely restricts the cleaning efficiency, which is needed for quick processing.

Another problem with attempts to use carbon dioxide in cleaning is the fact that the solvent power of dense carbon dioxide is not high compared to ordinary liquid solvents. Thus, there have been attempts to overcome this solvent limitation.

German Patent Application 3904514, published Aug. 23, 1990, describes a process in which supercritical fluid or fluid mixture, which includes polar cleaning promoters and surfactants, may be practiced for the cleaning or washing of clothing and textiles.

PCT/US89/04674, published Jun. 14, 1990, describes a process for removing two or more contaminants by contacting the contaminated substrate with a dense phase gas where the phase is then shifted between the liquid state and the supercritical state by varying the temperature. The phase shifting is said to provide removal of a variety of contaminants without the necessity of utilizing different solvents.

However, the problems of relatively slow processing, limited solvent power, and redeposition have seriously hindered the usefulness of carbon dioxide cleaning methods.

Another particularly serious obstacle to commercial acceptability of dense gas cleaning is the fact that when certain solid materials, such as polyester buttons on fabrics or polymer parts, are removed from a dense gas treatment they are liable to shatter or to be severely misshapened. This problem of surface blistering and cracking for buttons or other solids has prevented the commercial utilization of carbon dioxide cleaning for consumer clothing and electronic parts.

SUMMARY OF THE INVENTION

Accordingly, it is an object of the present invention to provide a cleaning system in which an environmentally safe non-polar solvent such as densified carbon dioxide can be used for rapid and efficient cleaning, with decreased damage to solid components such as buttons and increased performance.

It is another object of the present invention to provide a cleaning system with reduced redeposition of contaminants, that is adaptable to the incorporation of active cleaning materials that are not necessarily soluble in the non-polar solvent.

Yet another object is to provide a cleaning system that employs a rotatable inner drum designed to hold the substrate during cleaning and a system in which the cleaning fluid is recycled.

A still further object of the invention is to provide a means for imparting a dense gas-soluble or dispersible adjuncts, such as means for scenting, to the substrate so as to aesthetically or commercially improve the substrate.

In one aspect of the present invention, a system is provided for cleaning contaminated substrates. The system includes a sealable cleaning vessel containing a rotatable drum adapted for holding the substrate, a cleaning fluid storage vessel, and a gas vaporizer vessel for recycling used cleaning fluid. The drum is magnetically coupled to an electric motor so that it can be rotated during the cleaning process.

The inventive system is particularly suited for automation so that the system can be regulated by a microprocessor. Moreover, automation permits increased energy efficiency as the heating and cooling effect associated with $CO_2$ gas condensation and expansion can be exploited to heat and cool various parts of the system.

DESCRIPTION OF THE PREFERRED EMBODIMENTS

Figure 1:
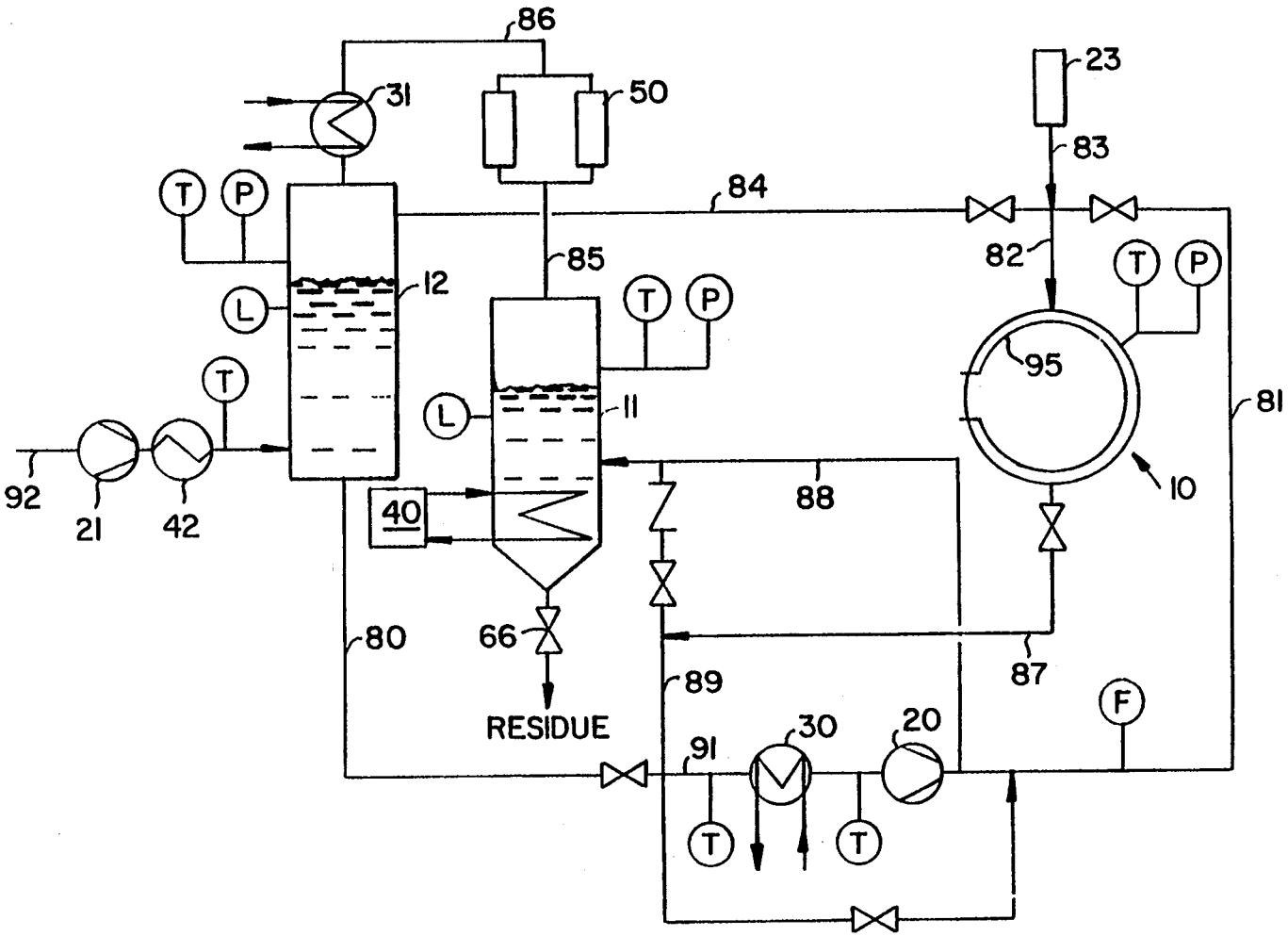
FIG. 1 is a diagrammatic flow sheet showing the system of the invention.

A cleaning system that can use a substantially non-polar fluid such as densified carbon dioxide ($CO_2$) as the cleaning fluid is shown schematically in FIG. 1. The system generally comprises three vessels, the cleaning vessel 10, preferably a rotatable drum, the gas vaporizer vessel 11, and the storage vessel 12, all of which are interconnected. The cleaning vessel, where soiled substrates (e.g. clothing) are received and placed into contact with the cleaning fluid is also referred to as an autoclave. As will be described further below, much of the $CO_2$ cleaning fluid is recycled in this system.

$CO_2$ is often stored and/or transported in refrigerated tanks at approximately 300 psi and −18° C. In charging the inventive system with $CO_2$, pump 21 is adapted to draw low pressure liquid $CO_2$ through line 92 that is connected to a refrigerated tank (not shown) through make-up heater 42 which raises the temperature of the $CO_2$. The heater preferably has finned coils through which ambient air flows and employs resistive electric heating. Pump 21 is a direct drive, single-piston pump. Liquid $CO_2$ is then stored in the storage vessel 12 at approximately 915 psi and 25° C. The storage vessel is preferably made of stainless steel. As shown in FIG. 1, conventional temperature gauges (each depicted as an encircled "T"), pressure gauges (each depicted as an encircled "P"), liquid $CO_2$ level meters (each depicted as an encircled "L"), and a flowmeter (depicted as an encircled "F") are employed in the system. In addition, conventional valves are used.

In operation, after placing soiled substrate into the cleaning vessel, the cleaning vessel is then charged with gaseous $CO_2$ (from the storage vessel) to an intermediate pressure of approximately 200–300 psi to prevent extreme thermal shock to the chamber. The gaseous $CO_2$ is transferred into the cleaning vessel through lines 82 and 84. Thereafter, liquid $CO_2$ is pumped into the cleaning vessel from the storage vessel through lines 80, 91, 81, and 82 by pump 20 which preferably has dual pistons with either direct or hydraulic/electric drive. The pump raises the pressure of the liquid $CO_2$ to approximately 900 to 1500 psi. Subcooler 30 lowers the temperature of the $CO_2$ by 2° to 3° below the boiling point to prevent pump cavitation. The temperature of the $CO_2$ can be adjusted by heating/cooling coils 95 located inside the cleaning vessel. Before or during the cleaning cycle, cleaning additives may be added into the cleaning vessel by pump 23 through lines 82 and 83. Moreover, pump 23 through lines 82 and 83 can also be used to deliver a compressed gas into the cleaning vessel as described below.

Figure 3:
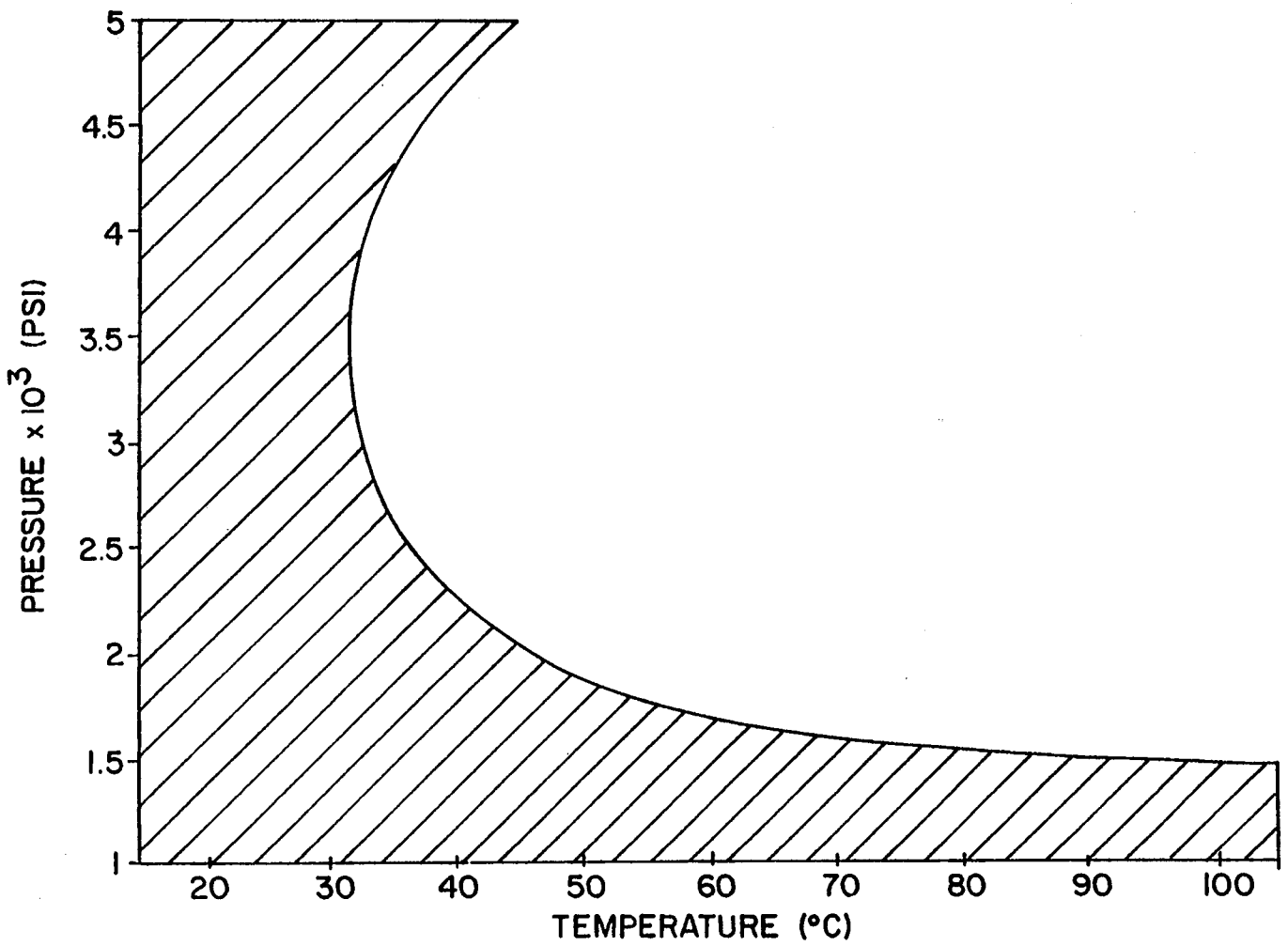
FIG. 3 graphically illustrates temperature and pressure conditions within a hatched area in which cleaning is preferably carried out for reduced button damage.

Practice of the invention requires contact of a substrate having a contaminant with the first, substantially non-polar fluid that is in a liquid or in a supercritical state. With reference to FIG. 3, when using $CO_2$ as the first fluid, its temperature can range broadly from slightly below about 20° C. to slightly above about 100° C. as indicated on the horizontal axis and the pressure can range from about 1000 psi to about 5000 psi as shown on the vertical axis. However, within this broad range of temperature and pressure, it has been discovered that there is a zone (represented by the hatched area of the left, or on the convex side, of the curve) where surface blistering to components such as buttons can be reduced, whereas practice outside of the zone tends to lead to button damage that can be quite severe. As is seen by the hatched region of FIG. 3, preferred conditions are between about 900 psi to 2000 psi at temperatures between about 20° C. to about 45° C., with more preferred conditions being pressure from about 900 psi to about 1500 psi at temperatures between about 20° C. and 100° C. or from about 3500 psi to about 5000 psi at temperatures between about 20° C. and 37° C. Where fabrics are being cleaned, one preferably works within a temperature range between about 20° C. to about 100° C. In addition, it has been found within this range that processes which raise the temperature prior to decompression reduce the damage to polymeric parts.

Suitable compounds as the first fluid are either liquid or are in a supercritical state within the temperature and pressure hatched area illustrated by FIG. 3. The particularly preferred first fluid in practicing this invention is carbon dioxide due to its ready availability and environmental safety. The critical temperature of carbon dioxide is 31° C. and the dense (or compressed) gas phase above the critical temperature and near (or above) the critical pressure is often referred to as a "supercritical fluid." Other densified gases known for their supercritical properties, as well as carbon dioxide, may also be employed as the first fluid by themselves or in mixture. These gases include methane, ethane, propane, ammonium-butane, n-pentane, n-hexane, cyclohexane, n-heptane, ethylene, propylene, methanol, ethanol, isopropanol, benzene, toluene, p-xylene, chlorotrifluoromethane, trichlorofluoromethane, perfluoropropane, chlorodifluoromethane, sulfur hexafluoride, and nitrous oxide.

Although the first fluid itself is substantially non-polar, it may include other components, such as a source of hydrogen peroxide and an organic bleach activator therefor, as is described in copending application Ser. No. 754,809, filed Sep. 4, 1991, inventors Mitchell et al., of common assignment herewith. For example, the source of hydrogen peroxide can be selected from hydrogen peroxide or an inorganic peroxide and the organic bleach activator can be a carbonyl ester such as alkanoyloxybenzene. Further, the first fluid may include a cleaning adjunct such as another liquid (e.g., alkanes, alcohols, aldehydes, and the like, particularly mineral oil or petrolatum), as described in Ser. No. 715,299, filed Jun. 14, 1991, now U.S. Pat. No. 5,279,615, inventor Mitchell et al., of common assignment herewith.

In a preferred mode of practicing the present invention, fabrics are initially pretreated before being contacted with the first fluid. Pretreatment may be performed at about ambient pressure and temperature, or at elevated temperature. For example, pretreatment can include contacting a fabric to be cleaned with one or more of water, a surfactant, an organic solvent, and other active cleaning materials such as enzymes. Surprisingly, if these pretreating components are added to the bulk solution of densified carbon dioxide (rather than as a pretreatment), the stain removal process can actually be impeded.

Since water is not very soluble in carbon dioxide, it can adhere to the substrate being cleaned in a dense carbon dioxide atmosphere, and impede the cleaning process. Thus, when a pretreating step includes water, then a step after the first fluid cleaning is preferable where the cleaning fluid is contacted with a hygroscopic fluid, such as glycerol, to eliminate water otherwise absorbed onto fabric.

Prior art cleaning with carbon dioxide has typically involved an extraction type of process where clean, dense gas is pumped into a chamber containing the substrate while "dirty" dense gas is drained. This type of continuous extraction restricts the ability to quickly process, and further when pressure in the cleaning chamber is released, then residual soil tends to be redeposited on the substrate and the chamber walls. This problem is avoided by practice of the inventive method (although the present invention can also be adapted for use as continuous extraction process, if desired).

The time during which articles being cleaned are exposed to the first fluid will vary, depending upon the nature of the substrate being cleaned, the degree of soiling, and so forth. However, when working with fabrics, a typical exposure time to the first fluid is between about 1 to 120 minutes, more preferably about 10 to 60 minutes. In addition, the articles being cleaned may be agitated or tumbled in order to increase cleaning efficiency. Of course, for delicate items, such as electronic components, agitation may not be recommended.

In accordance with the invention, the first fluid is replaced with a second fluid that is a compressed gas, such as compressed air or compressed nitrogen. By "compressed" is meant that the second fluid (gas) is in a condition at a lower density than the first fluid but at a pressure above atmospheric. The non-polar first fluid, such as carbon dioxide, is typically and preferably replaced with a non-polar second fluid, such as nitrogen or air. Thus, the first fluid is removed from contact with the substrate and replaced with a second fluid, which is a compressed gas. This removal and replacement preferably is by using the second fluid to displace the first fluid, so that the second fluid is interposed between the substrate and the separate contaminant, which assists in retarding redeposition of the contaminant on the substrate. The second fluid thus can be viewed as a purge gas, and the preferred compressed nitrogen or compressed air is believed to diffuse more slowly than the densified first fluid, such as densified carbon dioxide. The slower diffusion rate is believed useful in avoiding or reducing damage to permeable polymeric materials (such as buttons) that otherwise tends to occur. However, the first fluid could be removed from contact with the substrate, such as by venting, and then the second fluid simply introduced. This alternative is a less preferred manner of practicing the invention.

Most preferably, the second fluid is compressed to a value about equal to $P_1$ at a temperature $T_1$ as it displaces the first fluid. This pressure value of about $P_1/T_1$ is about equivalent to the pressure and temperature in the chamber as the contaminant separates from the substrate. That is, the value $P_1$ is preferably the final pressure of the first fluid as it is removed from contact with the substrate. Although the pressure is thus preferably held fairly constant, the molar volume can change significantly when the chamber that has been filled with first fluid is purged with the compressed second fluid.

The time the substrate being cleaned will vary according to various factors when contacting with the first fluid, and so also will the time for contacting with the second fluid vary. In general, when cleaning fabrics, a preferred contacting time will range from 1 to 120 minutes, more preferably from 10 to 60 minutes. Again, the articles being cleaned may be agitated or tumbled while they are in contact with the second fluid to increase efficiency. Preferred values of $P_1/T_1$ are about 800 to 5000 psi at 0° C. to 100° C., more preferably about 1000 to 2500 psi at 20° C. to 60° C.

Stained and soiled garments can be pretreated with a formula designed to work in conjunction with $CO_2$. This pretreatment may include a bleach and activator and/or the synergistic cleaning adjunct. The garments are then placed into the cleaning chamber. As an alternate method, the pretreatment may be sprayed onto the garments after they are placed in the chamber, but prior to the addition of $CO_2$.

The chamber is filled with $CO_2$ and programmed through the appropriate pressure and temperature cleaning pathway. Other cleaning adjuncts can be added during this procedure to improve cleaning. The $CO_2$ in the cleaning chamber is then placed into contact with a hygroscopic fluid to aid in the removal of water from the fabric. The second fluid (compressed gas) is then pumped into the chamber at the same pressure and temperature as the first fluid. The second fluid displaces the first fluid in this step. Once the first fluid has been flushed, the chamber can then be decompressed and the clean garments can be removed.

In order to recycle most of the $CO_2$ from the cleaning vessel as it is being replaced by the compressed gas, the $CO_2$ is drained from the cleaning vessel into the vaporizer vessel 11 which is equipped with an internal heat exchanger 40. The cleaning vessel is drained through lines 87, 89, 91, and 88 by pump 20 thereby recovering gaseous $CO_2$ at a pressure of approximately 200 psi. During the recovery process, the cleaning vessel is simultaneously heated; unrecovered $CO_2$ is vented to atmosphere. From the vaporizer vessel, $CO_2$ is continuously repurified by stripping the gaseous $CO_2$ with activated charcoal in filters 50 and thereafter condensing the clean gaseous $CO_2$ by condenser 31 so that the recovered $CO_2$ reenters the storage vessel for later use. Soil, water, additives, and other residues are periodically removed from the vaporizer vessel through valve 66.

Figure 2:
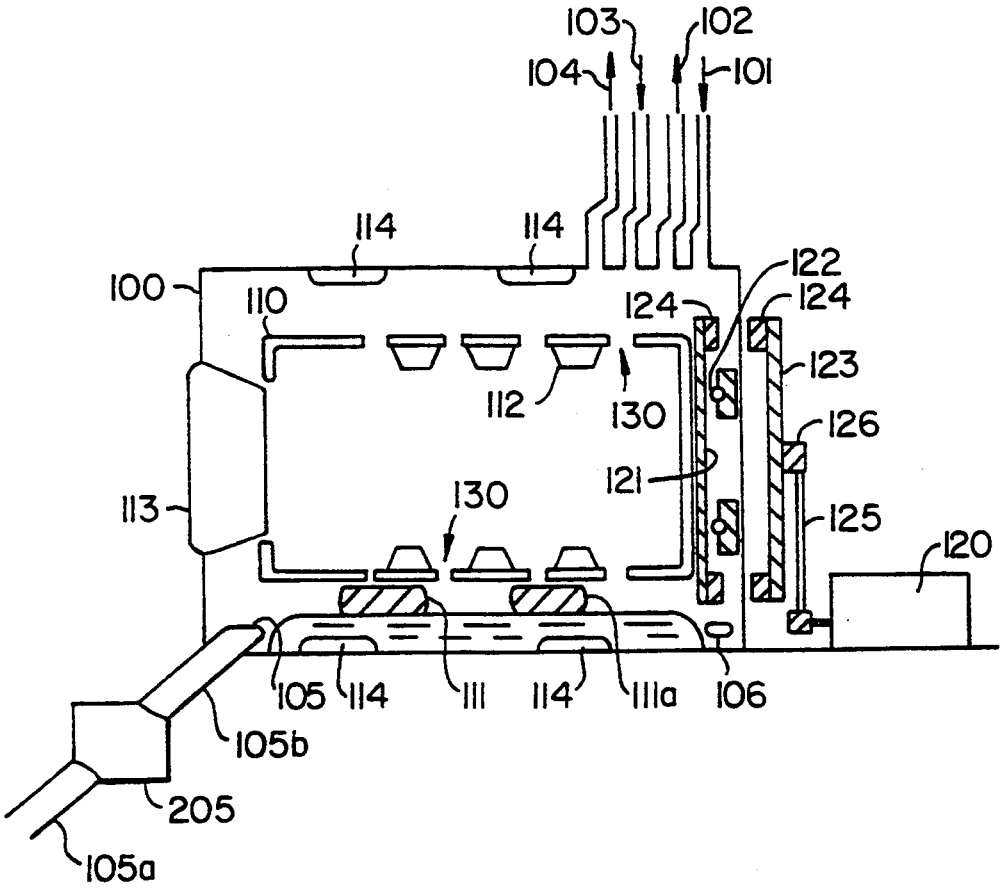
FIG. 2 is a cross-sectional view of the cleaning vessel.

Referring to FIG. 2 is a cross-sectional diagrammatic view of a cleaning vessel that is particularly suited for cleaning fabric substrates (e.g., clothing) with supercritical $CO_2$. The cleaning vessel comprises an outer chamber 100 having gaseous $CO_2$ inlet and outlet ports 101 and 102, compressed gas (e.g. air) inlet and outlet ports 103 and 104, and liquid $CO_2$ inlet and outlet ports 105 and 106. Although the gaseous $CO_2$, compressed gas, and liquid $CO_2$, each have separate inlet and outlet ports, the cleaning vessel may instead have one port for both inlet and outlet functions for each fluid.

In a further embodiment of the invention, a smaller container or chamber 205 is downstream of main chamber 100 and is preferably in-line with the liquid $CO_2$ inlet port 105. Inlet tube 105A leads to container 205 and outlet tube 105B leads to inlet port 105. The purpose of container 205 is to hold a means for imparting to the substrate cleaned by the cleaning vessel an aesthetic or commercially enhancing material soluble or dispersible in the dense or supercritical fluid, such as liquid $CO_2$. One of the principal, but not sole, uses for this means for imparting an aesthetic or commercially enhancing material would be scenting—preferably vegetative matter containing essential oils. The vegetative matter can include, but is not limited to, for example, flower petals, herbs, bark, leaves, from which can be extracted essential oils or other compounds soluble in liquid $CO_2$, such as exemplified in a non-limiting manner, camphor, menthol oils, orange oils, rose oils and the like. Further non-limiting uses for the aesthetic or commercially enhancing material soluble or dispersible in the dense gas or supercritical fluid include adding a natural insect repellent, such as pyrethrum, to cleaned fabrics, and using fragrances imparted to bedding in the practice of aromatherapy. Also, water repellent and further pest repellent materials (e.g., paradichlorobenzene, known moth repellent) could be contacted to cleaned fabrics, again, so long as such materials were soluble or dispersible in the dense or supercritical fluid or gas. Yet further, it is known that lanolin, a natural oil from wool, is soluble in dense or supercritical fluid. So, in a variation of this embodiment, lanolin stripped off from wool fabrics could be distilled or fractionated or filtered to remove impurities, such as soils, and at least partially recovered and replaced in such cleaned wool fabrics.

In the preferred practice, the substrate or article to be cleaned, such as fabrics, would be placed into the chamber as explained further below. While the fabrics are being cleaned with liquid $CO_2$, the means for imparting aesthetic or commercially enhancing material soluble or dispersible in the dense or supercritical fluid, e.g., essential oils, can be loaded into sealable container 205. After sealing said container 205, more liquid $CO_2$ can be introduced by inlet tube 105A and the essential oils in the means for imparting aesthetic or commercially enhancing material can be extracted, as known in the art (See, egs., Fremont, U.S. Pat. No. 4,308,200, and Katz, U.S. Pat. No. 4,820,537, both of which are incorporated herein by reference thereto). Thereafter, the dissolved oils can be introduced into main chamber 100, either during the cleaning cycle or before, after or during the purge cycle with compressed gas. The use of such means will obviously have aesthetic and commercial value. Further, although means for imparting aesthetic or commercially enhancing material to the substrate or article has been described herein as being in-line with the liquid $CO_2$ inlet port, in fact, it may be possible to position container 205 in-line with the gaseous $CO_2$ inlet port 101, or elsewhere in fluid communication with the chamber 100. This latter mode may be advantageously practiced when, as described above, after liquid $CO_2$ has been used to clean fabrics, and then is displaced by compressed gas, the $CO_2$ is in gaseous phase and being recovered and recycled. While this "spent" $CO_2$ is being "pumped down," the container with the aesthetic or commercially enhancing material could be solubilized in liquid $CO_2$ and allowed to descend from inlet port 101 and contact the cleaned fabrics.

Turning back to the description of the remaining components of FIG. 2, inside the chamber 100 is basket or drum 110 that is supported by two sets of rollers 111 and 111*a*. The basket has perforations 130 so that gaseous and liquid $CO_2$ can readily enter and exit the basket. Vanes 112 creates a tumbling action when the drum is spun. Substrates to be cleaned are placed into the basket through an opening in the chamber which is sealed by hinged door 113 when the cleaning vessel is in use. Situated along the perimeter of outer chamber are coils 114 through which coolant or heating fluid can be circulated. The drum in basket 110 is advantageous at exposing greater surface area of fabric substrates to the dense fluid and may also contribute to some mechanical partitioning of soil from fabric. Also, in case there is an interface or density gradient established in the chamber, rotation of the drum can "cycle" the fabrics causing partitioning of soils from fabrics. Additionally, the dense gas can advantageously be separated or driven off from the fabric by the rotational action of the drum.

The basket is magnetically coupled to an motor 120, which is preferably electric, so that the basket can be rotated. Other motive means for driving the basket are possible. Specifically, the inner basket is attached to a platform member 121 resting rotatably on ball bearings 122, and drive disk 123. The platform and drive disk are rotationally coupled by magnets 124 which are arranged, in suitable number, symmetrically around the circumference of each. The drive disk is coupled to the motor by belt 125 and pulley 126 or other appropriate means. When the basket is magnetically coupled to a motor, the basket can advantageously be sealed from the external environment with no loss of sealing integrity since drive shafts and other drive means which penetrate the basket are obviated. Thus, by using a magnetic coupling, drive shafts and associated sealing gaskets and the like can be avoided. Further, if the basket is magnetically coupled, the basket can advantageously be easily removed from and replaced in the chamber. In this manner, the basket can be a component unit and, if desired, different loads of fabrics with different laundering requirements can be batched into different baskets and thus loaded individually into the chamber one after another for ease of cleaning. The cleaning vessel is generally made from materials which are chemically compatible with the dense fluids used and sufficiently strong to withstand the pressures necessary to carry out the process, such as stainless steel or aluminum. The cleaning vessel as shown in FIG. 2 can be used as the autoclave 10 in the system as shown in FIG. 1.

It is to be understood that while the invention has been described above in conjunction with preferred specific embodiments, the description and examples are intended to illustrate and not limit the scope of the invention, which is defined by the scope of the appended claims.

It is claimed:

1. An apparatus for cleaning a substrate with a densified gas comprising:

a sealable cleaning vessel defining a compartment with temperature change means operatively associated therewith for adjusting the temperature within said compartment;

a rotatable drum adapted to receive the substrate, the drum being positionable inside the cleaning vessel compartment, the substrate being selectably in contact with a densified first gas when within the compartment;

a storage vessel in fluid communication with the compartment;

a gas vaporizer vessel in fluid communication with the compartment, wherein the storage vessel is in fluid communication with the gas vaporizer vessel by first conduit means;

a container containing means for imparting an aesthetic or commercially enhancing material soluble or dispersible in said densified first gas in fluid communication with the compartment; and means for introducing a compressed second gas at a selected pressure into said compartment for displacing said first densified gas.

2. The cleaning apparatus as defined in claim 1 wherein said container containing said means for imparting an aesthetic or commercially enhancing material is introduced into said compartment with said densified first gas.

3. The cleaning apparatus as defined in claim 1 wherein said means for imparting an aesthetic or commercially enhancing material further comprises vegetative matter containing essential oils.

* * * * *